United States Patent [19]

Guevara

[11] Patent Number: 4,761,906

[45] Date of Patent: Aug. 9, 1988

[54] FIREARM SAFETY DEVICE

[76] Inventor: Michael G. Guevara, 16575 #A San Ramon, Morgan Hill, Calif. 95037

[21] Appl. No.: 5,480

[22] Filed: Feb. 20, 1987

Related U.S. Application Data

[63] Continuation-in-part of Ser. No. 753,637, Jul. 10, 1985, abandoned.

[51] Int. Cl.[4] ..... F41C 17/08

[52] U.S. Cl. ..... 42/70.11; 42/66

[58] Field of Search ..... 42/70.11, 66, 70.06, 42/70.08, 70.01

[56] References Cited

U.S. PATENT DOCUMENTS

| | | | |
|---|---|---|---|
| 1,572,122 | 2/1926 | Pietrie | 70/31 |
| 1,728,902 | 9/1929 | Cohen | 70/31 |
| 2,327,334 | 8/1943 | Parker | 42/70.11 |
| 2,763,081 | 9/1956 | Huckabee | 42/70.11 |
| 3,089,272 | 5/1963 | McKinlay | 42/70.11 |
| 3,137,957 | 6/1964 | Ingalls | 42/70.11 |
| 3,774,333 | 11/1973 | Reynolds | 42/70.11 |
| 4,398,366 | 8/1983 | Wernicki | 42/70.11 |
| 4,461,108 | 7/1984 | Von Muller | 42/70.11 |
| 4,528,765 | 7/1985 | Johnson | 42/70.11 |
| 4,532,729 | 8/1985 | Von Muller | 42/70.11 |
| 4,576,021 | 3/1986 | Holden | 70/34 |
| 4,619,062 | 10/1986 | Johnson | 42/70.11 |

OTHER PUBLICATIONS

Sportsman's Digest by Hal Sharp from *The Sunday Star*–Washington, D.C., dated Oct. 26, 1969, one page.

*Primary Examiner*—Deborah L. Kyle
*Assistant Examiner*—Michael J. Carone
*Attorney, Agent, or Firm*—Cushman, Darby & Cushman

[57] ABSTRACT

A device is disclosed which disables a firearm from being loaded or fired. A firing-pin-blocking object is held in a space between a firearm firing pin and associated cartridge firing chamber. The pin-blocking object is adjustably attached to a rod which extends into a channel existing in the firearm. Typically, this channel is a pistol magazine chamber or a cartridge chamber of a cylinder. A block is lockably attached to an opposite end of the rod to hold the object in place adjacent the firing pin.

3 Claims, 2 Drawing Sheets

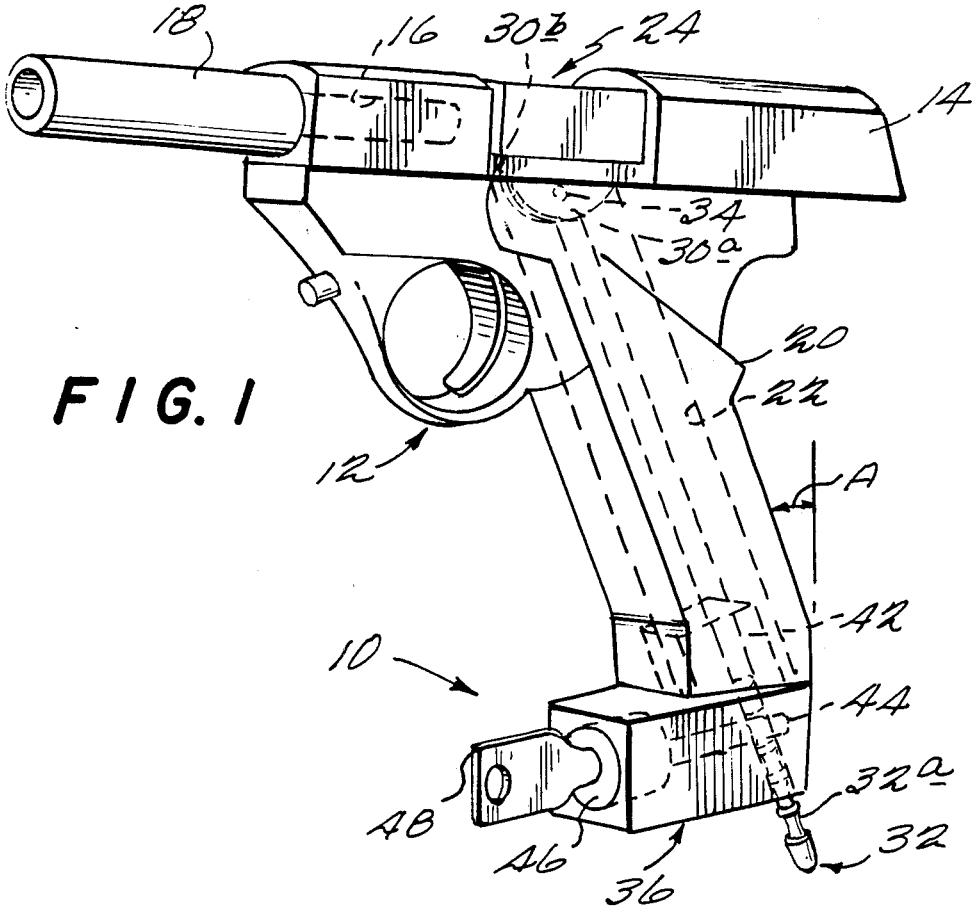
FIG. 1
FIG. 2
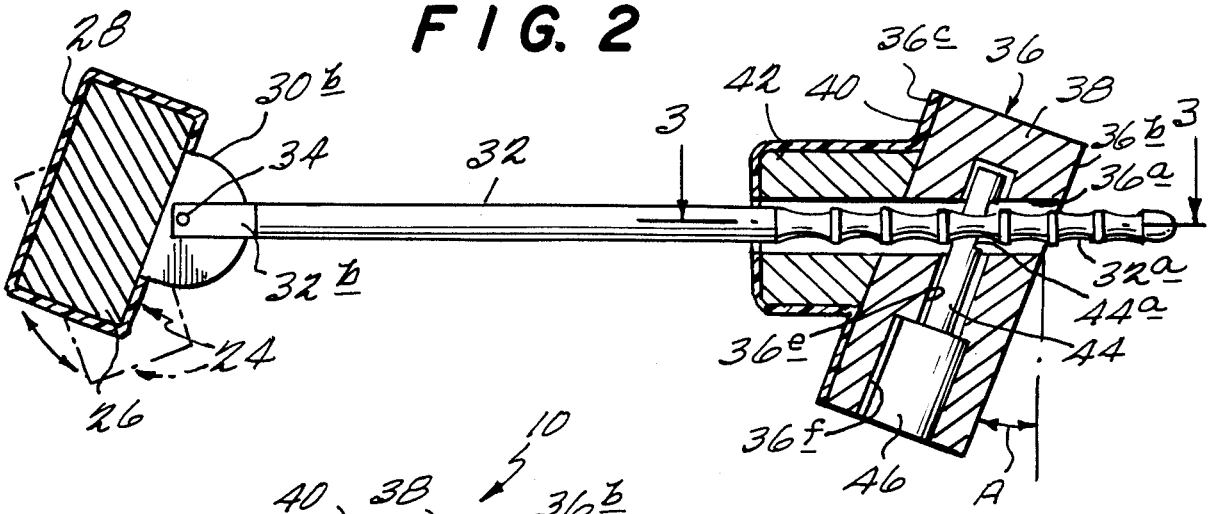
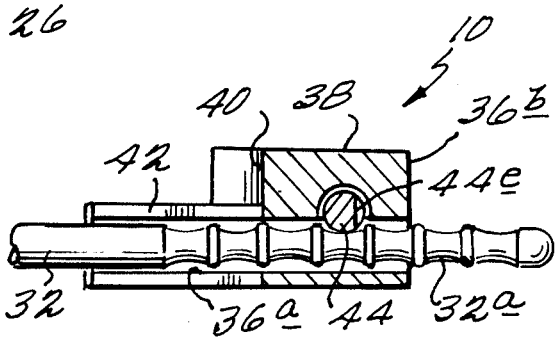
FIG. 3

FIREARM SAFETY DEVICE

BACKGROUND AND SUMMARY OF THE INVENTION

This application is a continuation-in-part of U.S. application having Ser. No. 753,637, filed July 10, 1985, now abandoned.

This invention pertains to devices which prevent the operation of firearms, and more particularly, to such devices which may be releasably and adjustably mounted on a firearm in a manner preventing it from being loaded or fired.

Firearms, whether they be handguns, shotguns or rifles, are by their nature potentially very dangerous. Many people possess firearms for various purposes including hunting and selfprotection. It is not uncommon to store them with ammunition where someone unauthorized or unintended has access to them. For example, many people keep a firearm in a nightstand or dresser in their bedroom for protection if a burglary occurs.

There are, thus, numerous instances of firearms being available to those that are not intended users. Some devices have been developed which are intended to avoid such unintended uses. These vary from a storage cabinet in which the firearms and ammunition are locked up to a device which is positionable behind a trigger to prevent the physical movement of the trigger. This latter type of device does allow the firearm to be loaded with ammunition and cocked so that it is in a condition ready for firing except for pulling the trigger. Thus, if the trigger guard can be defeated in any way the firearm becomes operable.

Each firearm has what may be considered a firing chamber in which cartridges are placed in preparation for firing. This chamber is aligned with a barrel which directs a fired bullet or shot in a desired direction. Associated with an end of the firing chamber opposite from the barrel is a firing pin which detonates the cartridge charge. In each firearm there is a space which exists (or can be made to exist by operation of the firearm) between a firing pin and firing chamber and a channel which extends from that space into the firearm. For instance, a revolver has a cylinder with plurality of cartridge chambers which may be positioned for loading. Some firearms, such as a pistol, have a magazine channel which extends from the firing chamber through the firearm handle or stock for receipt of a magazine which holds a plurality of cartridges.

The present invention provides a means which allows guns to be kept in a location where they are readily available for people but which prevents the guns from being fired, or even being loaded. Means are provided for mechanically isolating the firing pin from the firing chamber. It is adjustable for use in different firearms and can be selectively installed to prevent operation of the gun or removed to allow operation.

Since firearms are made in a variety of constructions, a single embodiment of the present invention does not fit all models. In general, however, each of the preferred embodiments of this invention includes a bar member which extends through a firearm channel. A firing pin blocking member is associated with one end of the bar member for positioning in the space between the firing pin and firing chamber. The bar member, and therefore the blocking member, is held in position by retaining bodies, such as a block that is associated with an end of the bar member opposite from the blocking member for securing the bar member in the channel. At least one of the blocking members is releasably attachable, preferably in a locked condition, to the bar member so that the device may be selectively and securely installed in a firearm. Further, adjusting means may be provided to accommodate the use of the invention in a variety of guns.

It can be seen that such a device allows a firearm to be kept in a convenient location, or even on display, while being maintained in a disabled condition. The invention includes other features and advantages which will become more apparent from a consideration of the drawings and the following detailed description of the preferred embodiment.

BRIEF DESCRIPTION OF THE DRAWINGS

FIG. 1 is a side perspective view of a pistol in which a firearm disabling device made according to the present invention is attached;

FIG. 2 shows an enlarged side, partially cross-sectional view of the device of FIG. 1;

FIG. 3 is a second cross-sectional view taken of a portion of the device of FIG. 2 along line 3—3;

DETAILED DESCRIPTION OF PREFERRED EMBODIMENTS

Figure 4:
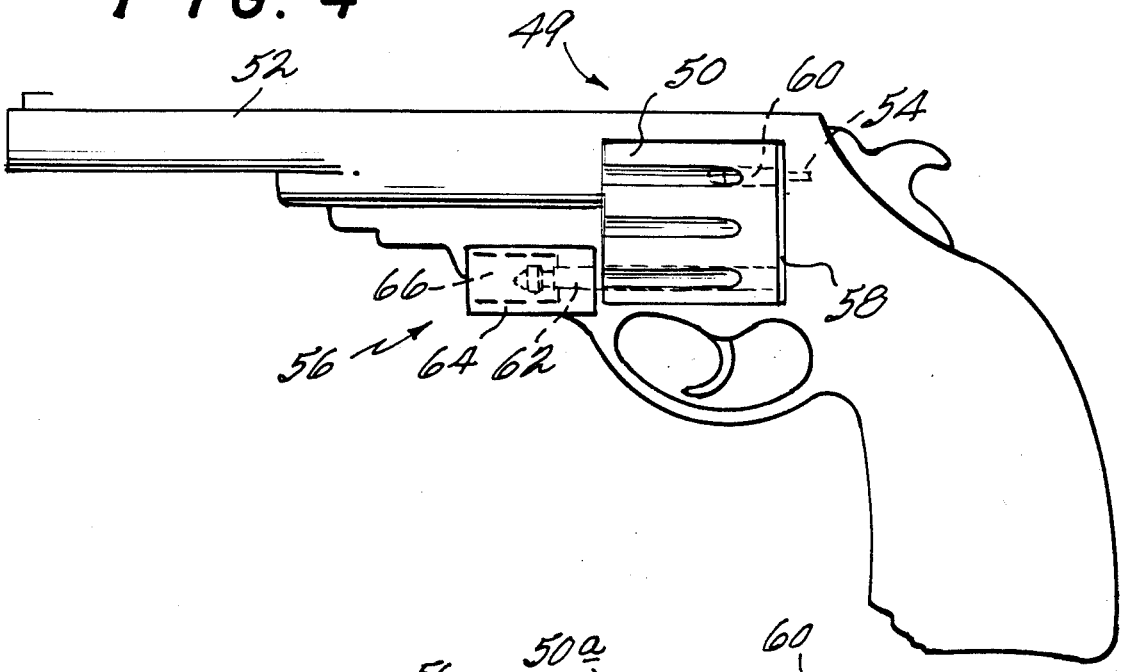
FIG. 4 is a side view of a revolver in which is installed another embodiment of the firearm disabling device made in accordance with the present invention.

Referring initially to FIG. 1, a first preferred embodiment of a firearm disabling device, shown generally at 10, made according to the present invention, is shown installed in a pistol, shown generally at 12. Pistol 12 includes a bolt or slide 14 which is shown partially pulled back as would be done to cock and load the gun for firing. Disposed on the leading face of slide 14 is a firing pin (not shown) disposed opposite a cartridge firing chamber shown in phantom lines at 16. Chamber 16 is in line with the bore in a barrel 18. Extending through a handle 20 is a channel 22, shown in phantom lines, which extends from the bottom or butt of the handle up to chamber 16. Channel 22 receives a magazine (not shown) loaded with cartridges during normal use of pistol 12.

Disabling device 10 includes means for mechanically isolating the firing pin from firing chamber 16. This is provided by an elongate rigid metallic or plastic block member 24 made of a pin-impenetrable core material 26 such as metal or rigid plastic, and a rubber covering 28. The block member is disposed between slide 14 and chamber 16 and is of a size sufficient to prevent its passage into channel 22.

Block member 24 is attached to an extension 30 which is pivotally attached to a bar member or rod 32, shown more clearly in FIGS. 2,3. Rod 32 is long enough to extend from the block member, as shown in FIG. 1, out through the bottom end of channel 22 where it terminates in a series of circumferentially extending indentations or grooves, such as groove 32*a*. Extension 30 consists of a pair of generally semicircular flanges 30*a*, 30*b*. These flanges are spaced apart to allow a flat end 32*b* of rod 32 to be slidably received between them. A pin 34 extends through the flanges and end 32*b* to attach the rod to block member 24 via extension 30 for pivoting about the longitudinal axis of the pin. The pivoting can also be seen to be in the plane of FIG. 2 which is parallel to the longitudinal axis of block member 24. The pivoting of block member 24 relative to rod 32 allows device 10 to be used in pistols having differently angled magazine channels relative to the axis of the barrel.

Releasably attached to the end of rod 32 having grooves 32*a* is a locking block member 36, preferably made of core 38 of metal or rigid plastic and a rubber covering 40 on at least those surfaces likely to contact the firearm. Block 36 includes a tubular bore or passageway 36*a* sized to slidably receive rod 32. Passageway 36*a* is disposed at an angle of approximately 75° relative to a bottom flat surface 36*b* of block 36. The complement of this angle is shown as angle A of approximately 15°, the angle between surface 36*b* and a line normal to the longitudinal axis of the passageway. Angle A is the angle between channel 22 and a line perpendicular to the bottom surface of handle 20 in pistol 12. Thus, block 36 may be slipped along rod 32 far enough so that its upper surface 36*c* is flush with the bottom surface of handle 20.

Extending upwardly from upper surface 36*c*, as viewed in FIG. 1, is an extension or tongue 42 sized to be inserted within channel 22. This prevents block 36 from being rotated relative to handle 20 once disabling device 10 is installed in a pistol 12. As can be seen, the sides of tongue 42, as viewed in FIG. 2, are parallel to passageway 36*a*, and therefore the line of channel 22. Extending into one end of block 36 parallel with surfaces 36*b*, 36*c* is a bore 36*e*, as shown, which extends far enough to intersect with passageway 36*a* along one edge at its inner end. A larger bore 36*f* extends coaxially with bore 36*e* and opens to one end of block 36. Rotatably disposed within bore 36*e* is a locking rod 44. Rod 44 is large enough to extend into passageway 36*a*, as shown. Disposed on one side of rod 44 is a groove 44*a* which is in line with passageway 36*a*. When rod 44 is turned so that groove 44*a* is in passageway 36*a* (as shown by a phantom line in FIG. 3) rod 32 may be freely inserted or removed from passageway 36*a*. When one of grooves 32*a* is aligned with locking rod 44, the rod may be turned approximately 90° to the position shown in the figures so that a shoulder of the rod extends into the associated groove, as particularly shown in FIG. 3. With rod 44 in this position, rod 32 may not be longitudinally moved relative thereto.

Disposed in the larger bore 36*f* is a lock cylinder 46. Cylinder 46 is a conventional cylinder for a lock operable by a key 48, as shown in FIG. 1. The turning of key 48 produces a corresponding turning in rod 44 between the two positions discussed previously. When rod 44 is turned into a locking position as shown in the figures, cylinder 46 is retainably held on rod 32. Key 48, of course, can be removed from block 36 with rod 44 in the position shown in the figures to leave rod 32 locked in passageway 36*a*.

It therefore can be seen that means are provided in this preferred embodiment for mechanically isolating the firing pin from firing chamber 16. This is provided by block member 24. Block member 24 and block 36 function as retaining bodies which retain rod 32 in channel 22.

It will be appreciated that the position of disabling device 10 as shown in FIG. 1 is the preferable orientation relative to pistol 12. However, it should also be apparent that it may be turned around so that block member 24 is disposed at the butt end of handle 20 and block 36 is disposed above the upper end of channel 22. In this orientation, tongue 42 would extend between the firing pin and firing chamber 16, into the upper end of chamber 22. In such an orientation the corresponding portion of tongue 42 serves as the block member relative to the firing pin and chamber.

It should also be apparent from the above discussion that disabling device 10 also provides, in this preferred embodiment, means for preventing loading of pistol 12. In particular, the extension of rod 32, with block member 24 and block 36 essentially plugging the opposite ends of channel 22 prevent its being loaded. Further, the placement of block member 24 between the firing pin and firing chamber 16 requires that slide 14 be pulled back into at least a partially cocked position. In this position the trigger of the pistol may not be pulled, thereby providing additional protection from unintentional operation of the firearm.

Figure 5:
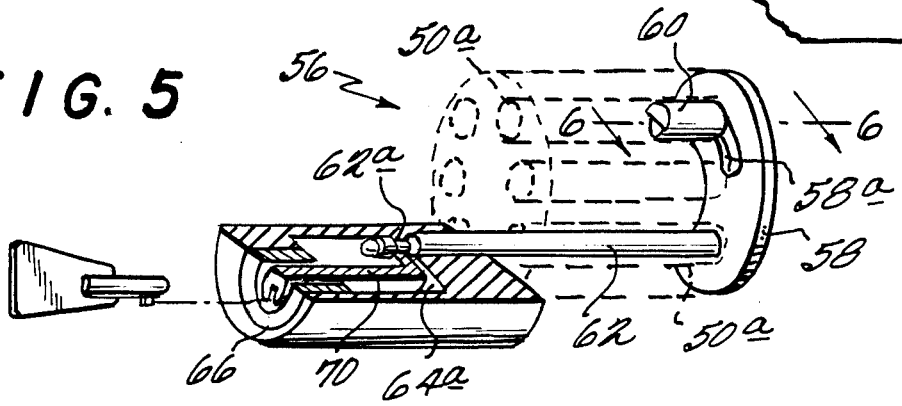
FIG. 5 is an enlarged partial cross-sectional view of the device of FIG. 4 showing construction details.
Figure 6:
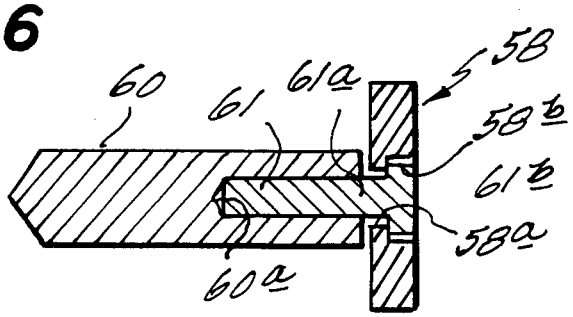
FIG. 6 is a cross-sectional view of a portion of the device of FIG. 5 taken along the plane normal to the arrows associated with line 6—6.

Directing attention now to FIGS. 4–6 an embodiment is shown usable with a revolver having a revolvable cylinder with a plurality of cartridge chambers. Some revolvers are loaded by swinging a cover out from the side of the firearm to expose a chamber for inserting cartridges therein. In others, including the one shown in FIG. 4, the cylinder swings out from a firing position to a loading position to provide access to it. In particular, a revolver, shown generally at 49, includes a cylinder 50 in which are disposed a plurality of cartridge chambers, such as chamber 50*a*. One of these chambers is positionable in line with barrel 52 adjacent a firing pin 54, shown in phantom lines. In this position it is considered a firing chamber. Each chamber may therefore be considered to be shiftable between a loading position in which the chamber is accessible for inserting a cartridge to a firing position in which it is adjacent the firing pin.

A firearm disabling device made according to the present invention, shown generally at 56, includes a thin plate 58 insertable in the narrow space between the cylinder and cylinder compartment wall on the body of revolver 49. Plate 58 is generally planar and has an arched shape, as shown in FIG. 5, to cover three cartridge chambers. Joined to one end of plate 58 is a rod member or plug 60 which is insertable in a cartridge chamber.

Disposed in plate 58 is a slot 58*a* which also is preferably generally arcuate, following the curve of plate 58. On the side of plate 58 opposite from plug 60 is a recessed portion surrounding slot 58*a* and having a recessed shoulder 58*b*. Plug 60 has a bore 60*a* extending partially into it as shown at the end of the plug adjacent plate 58. A pin 61 having a neck 61*a* sized to slidingly pass through slot 58*a* is forcefitted into bore 60*a*. On the top of neck 61*a*, opposite from plug 60 is a cap 61*b* sized to seat on shoulder 58*a* without passing through slot 58*a*. Thus, pin 61 holds plug 60 onto plate 58 while allowing the plug to be moved relative to the plate. This allows device 56 to be used on cylinders having different spacings between cartridge chambers.

When device 56 is installed in revolver 49 with cylinder 50 in its firing position, as shown in FIG. 4, plug 60 is disposed within the firing chamber adjacent firing pin 54. It should be noted that plate 58 may take other configurations as well. For instance, it may extend around the face of cylinder 50 to cover more or all of the cartridge chambers.

As will become clear, the structure shown and described provides adequate protection in that none of the remaining chambers may be loaded and the firing chamber is clearly obstructed by plug 60. Depending on the model of revolver, it may be possible to rotate cylinder 50 with device 56 installed. This can only be done to a limited degree because of the device. Thus, plate 58 covers all cartridge chambers which are positionable next to the firing pin.

Continuing a discussion of device 56, disposed parallel with plug 60 for insertion in another cartridge chamber is a bar member or rod 62 joined to the end of plate 58 opposite from the plug, as shown. Rod 62 is analogous in function to rod 32. The rod is of sufficient length to extend from plate 58 through cartridge chamber 50*a* and out the opposite end to where it terminates in a free end having grooves 62*a*, like grooves 32*a* on rod 32, described previously. A cylindrical block 64, similar in function to block 40 of the previous embodiment, includes a bore 64*a* extending in one end of the block and being sized to receive the free end of rod 62. A lock cylinder bore 64*b* extends inwardly from the opposite end so that the two bores slightly overlap. A lock cylinder 66, disposed in bore 64*b* is operable by a key 68 to rotate a locking rod 70. This rod has a laterally extending arm 70*a* at it distal end which is rotatable from a position extending into bore 64*a* and into a groove 62*a* when a rod 62 is inserted therein, to a position away from bore 64*a*. Thus, a selectively and releasably lockable attaching means is provided by cylinder 66, key 68 and rod 70 for attaching cylindrical block 64 to rod 62. In this way, plate 58 is releasably retained against cylinder 50. As is obvious, cylindrical block 64 is sized so that it is incapable of passage through cartridge chamber 50*a*. The general function and operation of disabling device 56 is essentially the same as the preferred embodiment described with reference to FIGS. 1–3.

While the invention has been particularly shown and described with reference to the foregoing preferred embodiments, it will be understood by those skilled in the art that other changes in form and detail may be made therein without departing from the spirit and scope of the invention. It is therefore intended that the coverage afforded applicant be limited only by the following claims and their equivalent language.

What I claim is:

1. A firearm safety device usable on a firearm having an externally exposable space between a cartridge firing chamber and associated firing pin, including a revolvable cylinder with a plurality of cartridge chambers each of which chambers is movable between a loading position in which both ends of the chamber are exposed and a firing position in which the chamber is disposed adjacent the firing pin in which position it functions as the firing chamber, said device comprising:

plate means disposable in the space between the firing pin and cylinder for mechanically isolating the firing pin from the firing chamber;

a pair of bar members sized to be received in cartridge chambers, attached at mutually spaced locations to said plate means, and extending from a common side of said plate means;

means for adjusting the distance on said plate means between said bar members to permit positioning of said bar members in differently spaced cartridge chambers; and means for releasably locking one of said bar members to a cylinder with said bar members disposed in respective ones of such cartridge chambers.

2. The device according to claim 1 wherein said adjusting means includes a slot disposed in said plate means and means for slidably retaining an end of a first of said bar members in said slot, said slot being disposed to allow movement of said end of said first bar member toward and away from the second bar member.

3. The device according to claim 2 wherein said adjusting means further includes a recessed shoulder extending around said slot, and said means for slidably retaining said first bar member end includes a pin attached to said first bar member having a neck sized to extend slidably in said slot and a cap disposed on said neck distally from said first bar member, said cap being sized to ride on said recessed shoulder and being large enough to prevent passage through said slot.

* * * * *